United States Patent [19]

Einhorn

[11] 4,079,909

[45] Mar. 21, 1978

[54] METHOD OF DIE CASTING AN ARTICLE HAVING A CAVITY AND HANGER PRODUCED THEREBY

[75] Inventor: Ruediger Einhorn, Katonah, N.Y.

[73] Assignee: Coats & Clark, Inc., Stamford, Conn.

[21] Appl. No.: 742,900

[22] Filed: Nov. 18, 1976

Related U.S. Application Data

[62] Division of Ser. No. 651,617, Jan. 22, 1976, Pat. No. 4,010,794.

[51] Int. Cl.[2] ..... B42F 13/00

[52] U.S. Cl. ..... 248/318; 24/128

[58] Field of Search ..... 24/128 R, 129 R, 129 B; 248/318

[56] References Cited

U.S. PATENT DOCUMENTS

| | | | |
|---|---|---|---|
| 370,239 | 9/1887 | Bombacher | 24/128 R |
| 1,791,507 | 2/1931 | Meyer | 24/128 R |
| 2,532,202 | 11/1950 | Steinbacher | 24/128 R |
| 3,995,822 | 12/1976 | Einhorn et al. | 248/339 |

*Primary Examiner*—James C. Mitchell
*Attorney, Agent, or Firm*—Burgess, Ryan and Wayne

[57] ABSTRACT

In a die casting technique, a first element is die cast with a cavity formed by a core, the first element having an interlocking surface such as a projection or shaped aperture. The core is then removed, and a second element is cast to extend into alignment with the cavity, employing the interlocking surface of the first element for a portion of the die in the formation of the second element. The second element is thereby interlocked with the first element to form a unitary article. The unitary article may be in the form of a hanger adaptable for use in extending a cord for suspending an object. The hanger has a body portion with a hole extending therethrough, one end of the hole being enlarged for receiving and holding therein the knot of a cord. A loop shaped portion of the hanger extends over the enlarged end of the hole. The loop shaped portion is rigidly affixed to the body portion, and serves as a hook.

4 Claims, 22 Drawing Figures

METHOD OF DIE CASTING AN ARTICLE HAVING A CAVITY AND HANGER PRODUCED THEREBY

This is a division of application Ser. No. 651,617, filed Jan. 22, 1976, now U.S. Pat. No. 4,010,794.

This invention relates to a method for die casting a unitary article having a cavity therein, and to a hanger that can advantageously be produced by this method.

In the formation of articles by die casting, it is frequently desirable to form articles having holes and cavities. If the hole or cavity is of constant cross section, and no portion of the article overlies the opening of the cavity or at least one end of the hole, then the article may be produced by conventional techniques. In this die casting technique, the article is die cast, employing a movable core for forming the cavity or hole. The core may be then removed from the cast article. The same die casting technique may be employed if the cavity or hole has a closed end, as well as if the cross dimensions of the hole or cavity do not decrease in the longitudinal direction of the cavity or hole toward the open end thereof.

A problem arises, however, in the formation of a number of shapes of articles by die casting, wherein a hole or cavity must be provided. For example, if a portion of the article is aligned with both ends of the hole, it is difficult to cast the article even though the hole has a uniform cross section. In such a circumstance, if the portion of the article overlying one of the ends of the hole is spaced sufficiently therefrom, then it may be possible to die cast the article employing a core for forming the hole, then withdrawing the core linearly from the hole, and finally withdrawing the core sideways of the article. This expedient is of course not practical if the overlying portion of the article is close to the end of the hole. Even if the technique is feasible for the formation of some articles, it is not adaptable to the mass production of die cast articles, particularly small die cast articles, in view of the additional step required in removing the core, as well as the added complexity of the dies and die assembly necessary for movement of the core.

It is apparent that the same difficulties arise if the cavity or hole has one closed end, with a portion of the article overlying the open end thereof. In addition, the problem arises if the hole or cavity has an enlarged end overlain by a portion of the article, even though the other end thereof is free.

In order to avoid confusion of terminology, in the following disclosure the terms "hole" and "cavity" will be employed synonymously to refer to a hollow portion in the die cast body, with at least one opening, whereby the cavity or hole may be formed by die casting material around a core, the hole or cavity being shaped so that the core may be removed through the opening of the hole or cavity.

One aspect of the invention is therefore directed to the provision of a die casting technique, wherein articles having cavities overlain by portions of the articles may be readily die cast, the method being readily adaptable to mass production die casting techniques.

Briefly stated, in accordance with this aspect of the invention, a first portion of the article is preliminarily formed, preferably by die casting, with the desired cavity, and without a portion overlying one open end of the cavity. If the cavity is of varying cross section, the first portion is of course formed without a portion of the element overlying the larger cross section end. The first portion is also formed with at least one interlocking surface spaced from the cavity. In one embodiment of the invention, the interlocking surface is in the form of at least one projection, the projection being formed to serve as an interlocking member, for example by having an enlarged cross section away from its base, or a hole extending therethrough.

In a further embodiment of the invention, the interlocking surface may be in the form of at least one additional cavity in the first formed portion of the article. This additional cavity preferably has a varying cross section, and also preferably is not a blind cavity. For example, the additional cavity may be in the form of two cavities of constant cross dimension joined to form a T-shaped cavity.

Following the formation of the first portion of the article, this portion is placed in a die cavity for the formation of the remainder of the article, so that the interlocking surface of the first formed portion serves as a portion of the die for the casting of another or the remaining portion of the article. The second portion of the article is thus cast to be firmly interlocked to the first portion. Since the main cavity of the first formed article has already been formed, the second cast portion of the article may extend to overlie the main cavity thereof.

The method in accordance with the invention thus employs only simple die casting technique, and is readily adaptable to mass production of the articles. In addition, since die casting techniques are employed, the method in accordance with the invention may be employed to provide the articles with ornamental configurations.

In another aspect of the invention, the above described method of the invention is readily adaptable to the formation of a hanger, which would be difficult to form by other techniques. It is frequently desired to hang or suspend an article, such as a flower pot, from a ceiling or the like, and for this purpose it is of course knwon to suspend the flower pot from a cord, rope or the like. There is of course no universally accepted length for the suspending system for the flower pot, since the vertical location of the flower pot depends upon the environment and the likes and dislikes of individuals. Consequently, it would not be feasible to provide universal lengths of hangers. In a solution to this problem, one may cut an available cord to a desired length, and tie the ends of the cord to conventionally available hooks or the like. This technique is of course not entirely satisfactory. Thus, flower pots and similar objects are frequently hung as ornamental objects in homes, and the knots required in a cord, to suspend the flower pot at the desired height, do not provide a pleasing appearance. In addition, the security of such suspensions is dependent upon the ability of the individual to tie secure knots, a capability which is not universal.

In accordance with this further aspect of the invention, a hanger of pleasing appearance adaptable to firmly hold the end of a cord or the like of any desired length, is comprised of a body portion having a hole extending therethrough for receiving the cord. One end of the hole is of enlarged diameter, so that it can receive and hold a simple knot, for example a simple overhand knot. The smaller diameter end of the hole will not pass the knot. In addition, the hanger has a loop rigidly affixed thereto and extending over but spaced from the enlarged end of the hole. This loop may be employed, for example, to suspend the hanger element from a conventional hook.

By employing one of these hangers at each end of a cord or the like, it is apparent that a cord of any desired length may be provided with hanger ends of pleasing appearance, which can be securely employed in the hanging of plants or the like.

In order that the invention will be more clearly understood, it will now be disclosed in greater detail with reference to the accompanying drawings, wherein.

Figure 1:
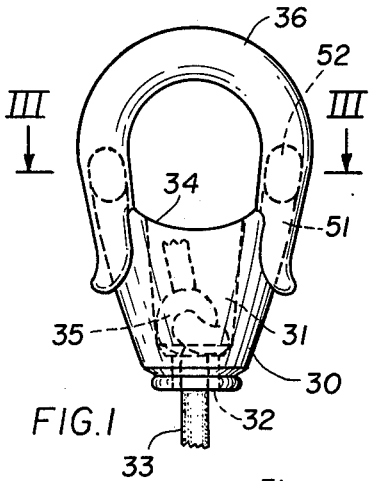
FIG. 1 is a plan view of one embodiment of a hanger in accordance with the invention.
Figure 2:
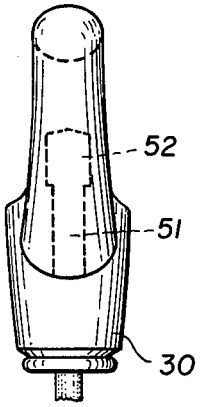
FIG. 2 is a side view of the hanger of FIG. 1.
Figure 3:
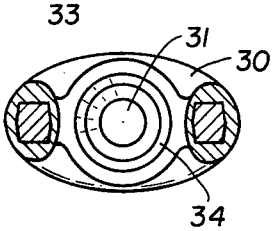
FIG. 3 is a cross sectional view of the hanger of FIG. 1 taken along the lines III—III.

Referring now to FIGS. 1, 2 and 3, a hanger in accordance with the invention is comprised of a body portion 30 having a hole 31 extending therethrough. One end 32 of the hole has a diameter substantially equal to the diameter of a cord 33 or rope to be held by the hanger. The other end 34 of the hole has an enlarged diameter, the enlarged diameter end 34 of the hole having an axial length sufficient to receive a knot 35 such as a simple overhand knot therein, whereby the knot will be entirely received within the body portion 30. While the enlarged diameter end 34 of the hole is shown as having a decreasing diameter toward the end 32, it will be apparent that this hole may have a uniform diameter at its end portion.

The hanger further has a loop shaped portion 36 extending from opposite sides of the body portion 30, around and spaced from the enlarged diameter end 34 of the hole 31.

The hanger of FIGS. 1–3 is preferably of a metal, and as will be discussed in greater detail in the following paragraphs, it may be die cast to have a pleasing ornamental appearance. While the hanger may be formed as a single element, for example, by casting, it is preferably formed in the two step die casting process to be discussed. Thus, the lines in these figures denoting internal construction are applicable only if the element is formed by the preferred method discussed in the following paragraphs.

Figure 4:
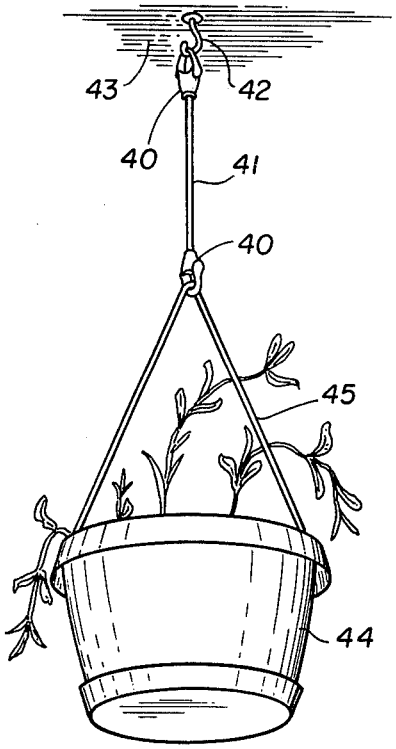
FIG. 4 is a perspective illustration of the use of a pair of hangers of the type illustrated in FIG. 1 for the suspension of a flower pot.

The use of the hanger of FIGS. 1–3 in suspending an object, such as a flower pot, is shown in FIG. 4. In this arrangement, a hanger 40 of the type shown in FIGS. 1–3 is provided at each end of a cord or rope 41, of any desired length. The assembly may of course be formed by inserting the ends of the cord or rope 41 in the narrow diameter holes of the hangers 40 a sufficient distance that the free ends of the cord or rope extend out of the enlarged diameter ends of the holes, tying simple knots in the ends of the cord or rope, and then pulling the hangers 40 to withdraw the knots into the enlarged diameter ends of the holes. A simple knot, such as an overhand knot, can be reliably tied by almost anyone, and since such a knot will not pass through the small diameter ends of the holes, the hangers will be firmly held to the ends of the cord or rope.

In the arrangement illustrated in FIG. 4, the upper hanger 40 may be suspended from a conventional hook 42 affixed to a ceiling 43, with the flower pot 44 being held by a cord or rope 45 passing through the loop of the lower hanger 40.

It will of course be apparent that the hanger in accordance with the invention may be employed to suspend other articles, as well as to provide means for holding the ends of a cord for other applications, regardless of the inclination of the cord or rope. For example, the hanger may be employed to hold or extend cord or rope in marine applications, as well as in other fields. The hanger is also useful in the extending or holding of macrame cord made from string.

Referring to FIG. 1, it is apparent that difficulties would be involved in forming the hanger by conventional casting techniques, due to the extension of the loop 36 over the enlarged portion 34 of the hole. In other words, it would not be possible to cast the article around a core having the shape of the hole, and then withdraw the core linearly, since the loop 36 would prevent such withdrawal of the core. If the clearance between the loop 36 and the large end of the hole is adequate, a core may be employed which can be withdrawn partially linearly, into the loop, and thence sidewardly to clear the loop. As discussed previously, however, even if the shape of the article permits this form of cast, the technique is not readily adaptable to mass production, and the dies are complicated thereby.

Figure 5:
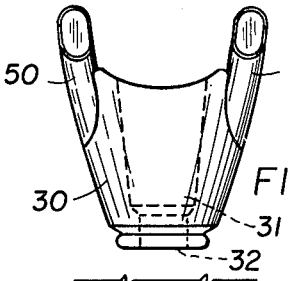
FIG. 5 is a plan view of a portion of the hanger of FIG. 1, illustrating a first step in the production thereof.

In order to overcome this problem, in accordance with the invention, the body portion 30 is cast without the loop portion 36, as illustrated in FIG. 5, but with an interlocking surface in the region that the loop joins the body portion. For example, as shown in FIG. 5, the interlocking surface may be comprised of a pair of projections 50 extending from the body portion. These projections 50, as illustrated in dashed lines in FIGS. 1 and 2, have narrow portions 51 where they meet the main portion of the body 32, and enlarged ends 52. The body portion 30, with projections 50, as shown in FIG. 5, may be readily formed by conventional die casting techniques. Thus, since the loop 36 is not present, a core may be provided of the same shape as the hole 31, with the body portion 30 being cast around this core. The core may then be readily linearly removed from the hole to complete the formation of the base portion. Following the casting of the body portion in this manner, the loop portion 36 is then cast onto the body portion 30, surrounding the projections 50. Due to the interlocking shape of the projections 50, with enlarged ends 52, the loop portion 36 is thereby firmly held and locked in a fixed position on the body portion 30.

Figure 6:
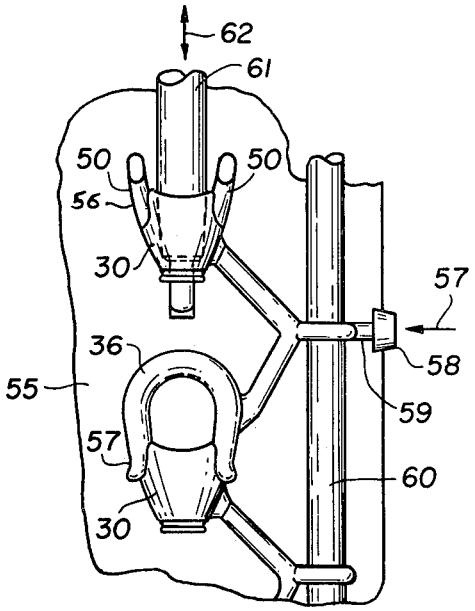
FIG. 6 is a simplified illustration of a die casting technique, in accordance with the invention, for forming the hanger of FIG. 1.

A casting apparatus for casting an article in accordance with the method of the present invention, such as the article of FIG. 1, is schematically illustrated in FIG. 6. The numeral 55 represents one die of a pair of movable dies for forming the article. The die 55 has one cavity 56 shaped to form the body portion 30 of the hanger, and a second cavity 57 in the form of the entire hanger, including the body portion 30 and the loop portion 36. In the casting process, heated material such as a zinc die casting material is directed in the direction indicated by the arrow 57, to the entrance sprue 58 of the die, and thence by way of a gate 59 around a transfer core rod 60. The gate 59 thence directs the metal to the cavity 56 and to the cavity 57. In the first step of the die casting process, a body portion 30 is inserted in the cavity 57, and a core rod 61 having on its ends the configuration of the hole of the article, is inserted in the cavity 56. After the dies are closed, the metal is injected into the dies by way of the sprue 58, so that a complete body portion 30 is formed in the cavity 56, and the loop portion 36 is formed on the preformed body portion 30 in the cavity 57. The core rod 61 is then linearly withdrawn from the cavity 56, as indicated by the arrow 62, the dies are opened, and the castings are moved, by means of the transfer core rod, into the next die position. In other words, the body portion 30 formed in the cavity 56 is moved into the cavity 57, and the article formed in the cavity 57 is removed from the dies for later processing. A two step process of the above type is disclosed. for example, in U.S. Pat. No. 2,819,494, Morin.

In the casting process it is to be noted that the projections 50 are formed on the body portion 30 in the cavity 56, and that when the complete article is formed in the cavity 57, the die casting metal completely or substantially completely surrounds the projections 50, so that the loop portion is formed around these projections and is firmly held thereto against the body portion 30. It is further to be noted that the core rod 61 may be readily linearly withdrawn from the body portion 30 cast in the cavity 56, since the loop portion of the final cast article has not yet been formed over the hole in the article. The hole in the article may thus have an enlarged end toward the loop portion.

Figure 7:
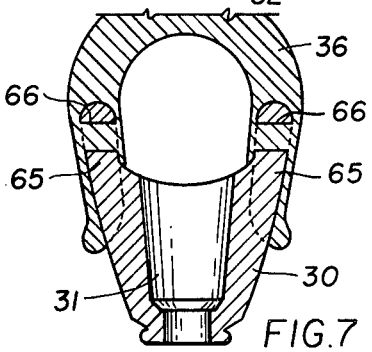
FIG. 7 is a cross sectional view of a portion of a modification of the hanger of FIG. 1.

It is of course apparent that other forms of interlocking surfaces may be provided on the body portion. Thus, as illustrated in FIG. 7, the projections 65 formed on the body portion 30 on opposite sides of the hole 31 do not have enlarged ends. Instead, a hole 66 is provided extending through each of these projections. These holes 66 may be formed in the first die casting step by employing additional linearly movable core rods according to conventional practice. Alternatively, the holes 66 may extend in the projections 65 noraml to the plane of FIG. 7, in which case these holes may be more simply made by solid die cores that are fixed parts of the die. Thus, when the loop portion 36 is cast around the projections 65, the metal flows into the holes 66, to firmly lock the loop portion to the projections.

The method of the invention may also be advantageously employed to form, by die casting or molding techniques, articles of other forms that cannot readily be cast or molded by conventional techniques. Such articles are illustrated generally in FIGS. 8, 9, 13, 14 and 18, 19. It will be understood that these figures have been employed only to show the adaptability of the casting or molding process in the formation of articles of different configurations, and the illustrated articles hence are simplified and not intended to represent articles useful per se.

Figure 8:
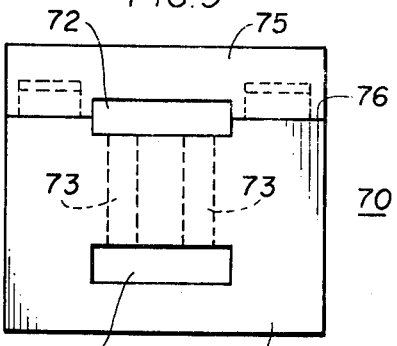
FIG. 8 is a plan view of a further article that may be formed in accordance with the invention.

The article illustrated in FIG. 8 is comprised of a block 70 having a pair of apertures 71 and 72 extending therethrough. One or more holes 73 extend in the block between the apertures 71 and 72. It is apparent that an article, having such a configuration would be difficult to form by conventional die casting or molding techniques, since portions 75 blocks removal of cores from the holes 73.

Figure 11:
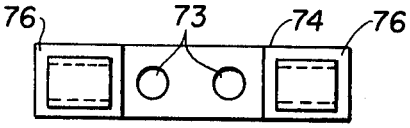
FIG. 11 is a top view of the portion of the article illustrated in FIG. 10.
Figure 9:
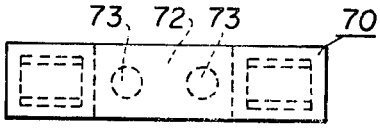
FIG. 9 is a top view of the article of FIG. 8.
Figure 10:
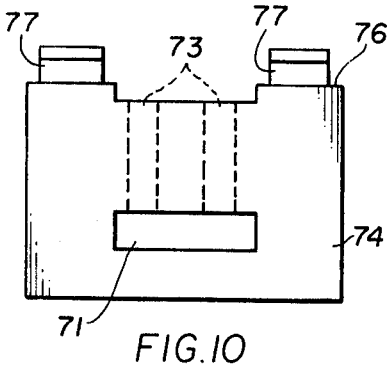
FIG. 10 is a plan view of a first formed portion of the article of FIG. 8.
Figure 12:
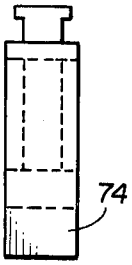
FIG. 12 is an end view of the portion of the article illustrated in FIG. 10.

In accordance with the invention, the article is formed in two steps, wherein a body portion 74 is first cast or otherwise formed, followed by casting or molding of a cap portion 75. The body portion 74, as illustrated in FIGS. 10–12, includes the aperture 71, the holes 73, and a portion of the aperture 72 surrounding the holes 73, but not extending over the holes 73. The dividing line between the portions 74 and 75 is therefore a surface 76, which may be a plane surface, extending through the aperture 75. A pair of projections 77 are provided on the body portion 74 extending from the surface 76, on opposite sides of the aperture 72. The projections 77 may have T-shaped cross sections, with the bottom of the leg of the T-shaped cross-sections joining the surface 76. The projections 77 thus form the interlocking surface as above described.

Following the formation of the body portion 74, the cap portion 75 is die cast or molded around the projections 77, and completing the surfaces of the aperture 72. The cap portion 75 is thereby firmly locked to the body portion 74 by the projections 77.

Figure 13:
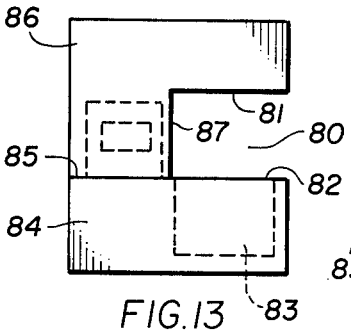
FIG. 13 is a plan view of a still further article that may be formed by the method of the invention.
Figure 14:
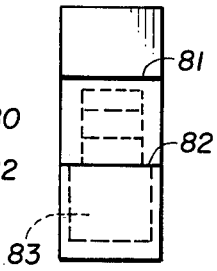
FIG. 14 is an end view of the article of FIG. 13.

The article illustrated in FIGS. 13 and 14 is generally C-shaped, although the external configuration of the article in this regard is not material to the casting process. The article has a slot 80 extending thereacross, whereby the slot 80 defines a pair of facing surfaces 81 and 82 of the article. A recess 83 extends into the article from the surface 82. Since the surface 81 extends in alignment with the recess 83, it would be difficult to form this article by conventional die casting or molding techniques.

Figure 16:
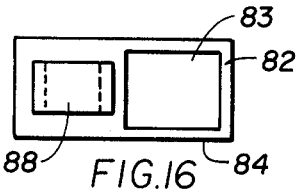
FIG. 16 is a top view of the portion of the article of FIG. 15.
Figure 15:
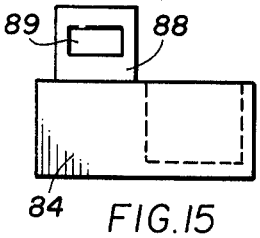
FIG. 15 is a plan view of a first formed portion of the article of FIG. 13.
Figure 17:
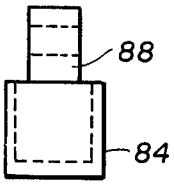
FIG. 17 is an end view of the portion of the article illustrated in FIG. 15.

In accordance with the invention, this article is also formed in two steps. In the first step, a portion 84, which includes the surface 82 and the recess 83 is first formed, as illustrated in FIGS. 15–17. The dividing surface 85, which may be a plane surface, between the portion 84 and the remainder 86 of the article intersects the slot 80, for example the bottom 87 of the slot between the surfaces 81 and 82. The location of the surface 85 may of course be selected at other portions of the body, as long as the portion 84 does not include any portion of the surface 80 or other portions of the article which overlie the recess 83.

A projection 88 is formed extending from the surface 85. As illustrated in FIGS. 15–17, the projection 88 may have uniform cross section, with a hole 89 extending transversely thereto. The projection 88 thus forms the interlocking surface as above discussed.

Following the formation of the portion 84, the remainder 86 of the article is die cast or molded to surround the projection 86, with the material of the remainder 86 flowing into the hole 89 to firmly lock the remainder 86 to the portion 84.

Figure 18:
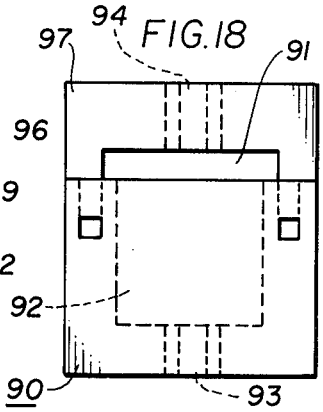
FIG. 18 is a plan view of still another article that may be formed in accordance with the method of the invention.
Figure 19:
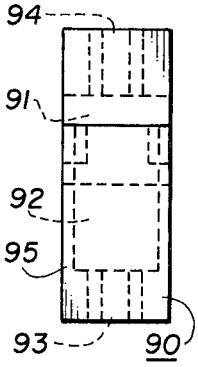
FIG. 19 is an end view of the article of FIG. 18.

The article of FIGS. 18 and 19 includes a body portion 90 with an aperture 91 extending therethrough. A recess 92 extends in the body 90 from the aperture 91. Holes 93 may extend from the recess 92 to the exterior surface of the body, and further holes 94 may be provided extending from the aperture 91 to the external surface of the body. It is apparent that it would be difficult if not impossible to form such an article, with the recess 92, by conventional casting or molding techniques.

Figure 21:
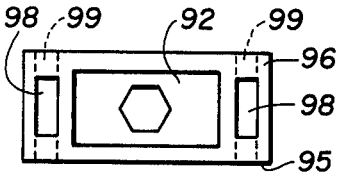
FIG. 21 is a top view of the portion of the article illustrated in FIG. 20.
Figure 20:
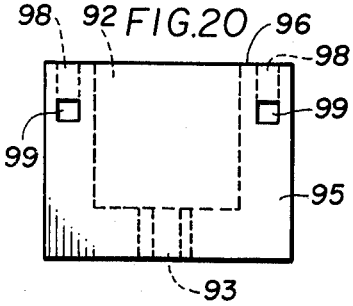
FIG. 20 is a plan view of a first formed portion of the article of FIG. 18.
Figure 22:
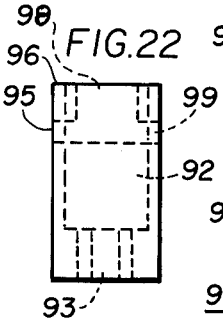
FIG. 22 is an end view of the portion of the article illustrated in FIG. 20.

In accordance with the invention, the article is formed in two steps, with a portion 95 including the recess 92 and the side of the aperture 91 which the recess 92 intersects being formed first, as illustrated in FIGS. 20–22. The boundary surface 96 between the portion 95 and the remainder 97 of the article may be a plane surface, and intersects the aperture 91 such that no part of the portion 95 overlies the recess 92.

The interlocking surface of the portion 95 is comprised of a pair of holes 98 extending into the portion 95 from the surface 96 on opposite sides of the recess 92. A further hole 99 extends transversely of the portion 95, each hole 99 intersecting the bottom of a separate hole 98. The portion 95 may be formed by conventional technique, for example by forming the recess 92 and holes 93 and 98 in a die about removable core rods. The holes 99 may be formed by solid cores which are a part of the die. Following the formation of the portion 95, the remainder 97 is die cast or molded as illustrated in FIGS. 18 and 19, with the material thereof flowing into the holes 98 and thence into the holes 99. The remainder 97 is thereby firmly blocked to the portion 95. The hole 94 is thereby firmly blocked to the portion 95. The hole 94 in the remainder 97 of the article may be formed, for example, about a removable core rod in the conventional manner. While the holes 93 and 94 are illustrated as being hexagonal, it is apparent that other configurations may be employed.

While each of the articles above described has been illustrated with a specific type of interlocking surface, this is for purposes of illustration only, and it is apparent that other types of interlocking surfaces may be employed in each of the articles. The interlocking surface may thus be in the form of a hole or porjection in the first formed portion, which has a configuration such that removal of the second formed portion engaging the interlocking surface is inhibited.

In a preferred method of the invention, the article of FIG. 1 was die cast from Zamak No. 3 zinc die casting alloy. It will be apparent, of course, that other die casting materials may be employed, and that the method in accordance with the invention is also adaptable to molding techniques for molding articles of plastic materials. It will further be apparent that the method of the invention is adaptable to the formation of other shapes and types of articles and is particularly useful for forming articles of some shapes which cannot be readily fabricated by other techniques. In general, the method in accordance with the invention is most advantageous in the formation of articles having cavities, recesses or holes wherein a portion of the article overlies at least a portion of the cavity, recess or hole. When a portion of the article does not extend into the cavity or recess, as in the above-described articles, it is preferable to form the entire cavity or recess in the first formed portion of the article. It is contemplated, however, that when articles are to be formed having cavities or recesses into which a portion of the article extends, the first formed portion of the article may define only a portion of the cavity, with the second formed portion defining the remainder of the surface of the cavity. Further, in the preferred method in accordance with the invention, the interlocking surface, such as a projection or hole, forms a portion of the die for die casting or molding the second formed portion of the article.

As in the illustrated embodiment of the invention, the interlocking surface is preferably spaced from the cavity, recess or hole in the first formed portion of the article. In addition, it is preferred that the interlocking surface not form a portion of the external surface of the completed article, especially for aesthetic reasons, although, as illustrated in FIGS. 18–22, the existence of the interlocking surface may be evident in the completed article. In addition, in most cases the interlocking of the portions of the article is more secure if the interlocking surface is formed completely within the article, although it will be apparent that the method in accordance with the invention is not limited to this feature.

Although only a limited number of embodiments of the invention have been disclosed and described, it will thus be apparent that variations and modifications may be made therein, and it is intended in the following claims to cover each such variation and modification as falls within the true spirit and scope of the invention.

What is claimed is:

1. A hanger device, comprising:

a die cast hanger body having a hole extending therethrough, one end of said hole having a larger cross-sectional area than the other end thereof, said body having two projections extending therefrom on opposite sides of said hole adjacent said one end thereof, each of said projections having an interlocking shape, and a die cast loop-shaped support element having the ends thereof rigidly and non-detachably interlocked to and surrounding respective ones of said projections, to secure said body to said element and prevent relative movement therebetween, the center portion of said element being in alignment with said hole.

2. The unitary hanger device of claim 1 wherein said projection is T-shaped, with the leg portion of each said projections extending from said body portion.

3. The unitary hanger device of claim 2 wherein said hole has a circular cross section, with said one end thereof having a larger diameter than the other end, and a transition between the diameters of the one end and other end intermediate said one end and other end.

4. The unitary hanger device of claim 3 wherein said body portion and support element are of the same material.

* * * * *

UNITED STATES PATENT OFFICE
CERTIFICATE OF CORRECTION

Patent No. 4,079,909 Dated March 21, 1978

Inventor(s) Ruediger Einhorn,

It is certified that error appears in the above-identified patent and that said Letters Patent are hereby corrected as shown below:

Column 5, line 68: "noraml" should be --normal--.

Column 7, line 54: "porjection" should be --projection--.

Column 8, line 56: "projection is" should be --projections are--.

Signed and Sealed this

*First* Day of *August 1978*

[SEAL]

*Attest:*

RUTH C. MASON
*Attesting Officer*

DONALD W. BANNER
*Commissioner of Patents and Trademarks*